US008194506B2

(12) United States Patent
Luk

(10) Patent No.: US 8,194,506 B2
(45) Date of Patent: Jun. 5, 2012

(54) ANALOG RADIO CONTROLLED CLOCK WITH AUDIO ALARM ARRANGEMENT

(76) Inventor: Tai Wai Luk, Hong Kong (HK)

( * ) Notice: Subject to any disclaimer, the term of this patent is extended or adjusted under 35 U.S.C. 154(b) by 726 days.

(21) Appl. No.: 12/277,274

(22) Filed: Nov. 24, 2008

(65) Prior Publication Data

US 2010/0128572 A1 May 27, 2010

(51) Int. Cl.
*G04C 11/02* (2006.01)
*G04C 21/14* (2006.01)
*G04C 21/00* (2006.01)

(52) U.S. Cl. ..... 368/47; 368/63; 368/74

(58) Field of Classification Search ..... 368/12, 368/47, 63, 72–74, 185, 187, 250, 251; 704/246, 704/251, 275
See application file for complete search history.

(56) References Cited

U.S. PATENT DOCUMENTS 3,855,574 A * 12/1974 Welty ..... 340/309.8
4,379,640 A * 4/1983 Inoue ..... 368/63
4,426,733 A * 1/1984 Brenig ..... 455/79
4,635,286 A * 1/1987 Bui et al. ..... 704/236
4,835,520 A * 5/1989 Aiello ..... 340/545.6
5,072,429 A * 12/1991 Mair ..... 368/10
5,144,600 A * 9/1992 Cheng ..... 368/12
5,444,673 A * 8/1995 Mathurin ..... 368/63
5,602,963 A * 2/1997 Bissonnette et al. ..... 704/275
5,794,205 A * 8/1998 Walters et al. ..... 704/275
6,173,060 B1 * 1/2001 Huang ..... 381/110
6,236,621 B1 * 5/2001 Schettino ..... 368/10
6,310,833 B1 * 10/2001 Guyett et al. ..... 368/63
6,965,543 B1 * 11/2005 Shum et al. ..... 368/47
2002/0095294 A1 * 7/2002 Korfin et al. ..... 704/275
2004/0066710 A1 * 4/2004 Yuen et al. ..... 368/73

* cited by examiner

*Primary Examiner* — Vit Miska
(74) *Attorney, Agent, or Firm* — Tsz Lung Yeung

(57) ABSTRACT

An analog radio controlled clock includes a housing, a plurality of indicating, a radio controlled unit, and an audio alarm arrangement, which includes an alarm control unit and an audio device. The alarm control unit is disposed in the receiving cavity of the housing to communicate with the driving control unit for allowing setup of an alarm time. The audio device is electrically connected with the alarm control unit, and is arranged to generate interactive audible signal to a user regarding setting of an alarm time, wherein the audio device is arranged to commands and transmits them to the alarm control unit for setting up the alarm time, so that the user is able to set up the alarm time through commands such as voice instructions and simple physical actuation to the analog radio controlled lock.

18 Claims, 5 Drawing Sheets

ANALOG RADIO CONTROLLED CLOCK WITH AUDIO ALARM ARRANGEMENT

BACKGROUND OF THE PRESENT INVENTION

1. Field of Invention

The present invention relates to a clock, and more particularly to an analog radio controlled clock comprising an alarm arrangement which enables a visually impaired user to easily set up alarm through voice signal.

2. Description of Related Arts

A conventional radio controlled clock (such as a conventional analog radio controlled clock) typically comprises a main housing, a plurality of indicating hands rotatably mounted in the main housing, a quartz driving unit coupled with the indicating hands to drive the indicating hands for indicating time, and a control unit provided in the main housing to receive wireless current time information from a reference time station, such as a local observatory, wherein the received radio signal is processed and converted to mechanical representation such that the indicating are driven to predetermined locations for indicating time which corresponds to the current time information transmitted by the radio signal.

A major advantage for conventional radio controlled clock is that the user does not need to refer to another timing device in order to adjust the time of the radio clock. For example, when the user buys a brand new conventional clock which is not a radio controlled clock, he or she has to refer to another timing device (such as his or her watch) and obtain information of the current time. Afterward, the user needs to adjust the time of his or her brand new clock to the current time obtained that another timing device. For radio controlled clock, the user needs only to arrange for receiving radio signal by the radio controlled clock and time information (i.e. location of the indicating hands) will be automatically adjusted upon proper receipt of the radio signal. This advantage is alleged to be of magnificently beneficial to the visually impaired, since the time setting for the clock can be accomplished through minimum physical actuations or control actions on the clock.

Despite this great advantage, conventional radio controlled clock does not cater for all people. In particular, conventional controlled radio clock does not contain any special mechanism for the visually impaired to set the alarm. Almost all of the radio controlled clocks require the user to manually rotate or actuate a predetermined switch provided on the clock in order to set the alarm. This means that even the visually impaired people will have to, despite their poor visual ability, locate and adjust the predetermined switch (usually provided at a rear side of the clock) in order to manually set the alarm. These are highly inconvenient, if not physically impossible, actions for the visually impaired. As a result, many people with impaired visual ability have to rely on other methods and devices (such as requiring special wake-up phone calls) to substitute their needs to traditional alarms. This situation holds true regardless of the types of clocks used (i.e. whether it is a conventional clock or a radio controlled clock).

SUMMARY OF THE PRESENT INVENTION

A main object of the present invention is to provide an analog radio controlled clock comprising an audio alarm arrangement which enables a visually impaired user to easily and conveniently set up alarm through simple physical actuations or voice signals.

Another object of the present invention is to provide an analog radio controlled clock comprising an audio alarm arrangement which facilitates rapid and convenient setup of alarm through verbal interaction between the radio controlled clock and the user. In other words, physical actuations of the radio controlled clock and visual requirement on the part of the user for setting up the alarm can be kept to the minimum.

Another object of the present invention is to provide an analog radio controlled clock comprising an audio alarm arrangement, wherein initial time setup and alarm setup can both be accomplished through voice signal or minimum physical actuations on the analog radio controlled clock, so as to provide the most optimal analog radio controlled clock for the visually impaired.

Another object of the present invention is to provide an analog radio controlled clock comprising an audio alarm arrangement, wherein the analog radio controlled clock utilizes generic gearbox for driving indicating hands to illustrate time, such that the audio alarm arrangement can be used in traditional analog radio controlled clocks without incurring expensive manufacturing cost.

Another object of the present invention is to provide a method of setting up an alarm in an analog radio controlled clock, wherein the method is optimally designed for visually impaired people to conveniently and quickly set up an alarm in a radio controlled clock. Therefore, the radio controlled clock of the present invention, because of its automatic adjustment of time and easy-setting alarm, provides a preferred timing device for the visually impaired.

In light of the above objects, the present invention provides an analog radio controlled clock, comprising:

a housing;

a plurality of indicating hands rotatably supported within the housing;

a driving control unit disposed within the housing and communicated with the indicating hands for driving the indicating hands to move at a predetermined interval for indicating time in a continuous basis;

a radio control unit provided in the housing and electrically communicated with the driving control unit, wherein the radio control unit is adapted to receive radio signal from a reference time station to obtain information of current time, wherein the information of the current time is transmitted to the driving control unit to drive the indicating hands to corresponding positions indicating corresponding current time; and an audio alarm arrangement, which comprises:

an alarm control unit disposed in the housing to communicate with the driving control unit for allowing setup of an alarm time; and an audio device which is electrically connected with the alarm control unit, and is arranged to generate interactive audible signal to a user regarding setting of the alarm time, wherein the audio device is arranged to receive a predetermined commands and transmits the commands received from the user to the alarm control unit to accomplish setup of the alarm time, so that the user is able to set up the alarm time through the command input to the audio device in responsive to the audible signal.

Moreover, the present invention provides a method of setting up an alarm in an analog radio controlled clock which comprises a plurality of actuating switches, and an audio alarm arrangement comprising an audio device, wherein the method comprises the steps of:

(a) delivering by the audio device a first audible instruction as to a first alarm setting of the radio controlled clock, wherein the second alarm setting corresponds to a second time on the radio clock;

(b) in response to the first audible instruction, actuating at least one of the actuating switches to confirm the first alarm setting as a current alarm setting or to modify the first alarm setting; wherein when the first alarm setting meets a desirable alarm setting, the first alarm setting is confirmed as the current alarm setting, wherein when the first alarm setting does not meet a desirable alarm setting, the first alarm setting is commanded to be modified;

(c) when the first alarm setting is commanded to be modified, delivering by the audio device a second audible instruction as to a second alarm setting of the radio clock, wherein the second alarm setting corresponds to a second time on the radio controlled clock;

(d) in response to the second audible instruction, actuating at least one of the actuating switches to confirm the second alarm setting as a current alarm setting or to modify the second alarm setting; and (e) repetitively carrying out the step (a) to the step (d) until the alarm setting meets with the desired alarm setting and is confirmed as the current alarm setting.

DETAILED DESCRIPTION OF THE PREFERRED EMBODIMENT

Figure 1A:
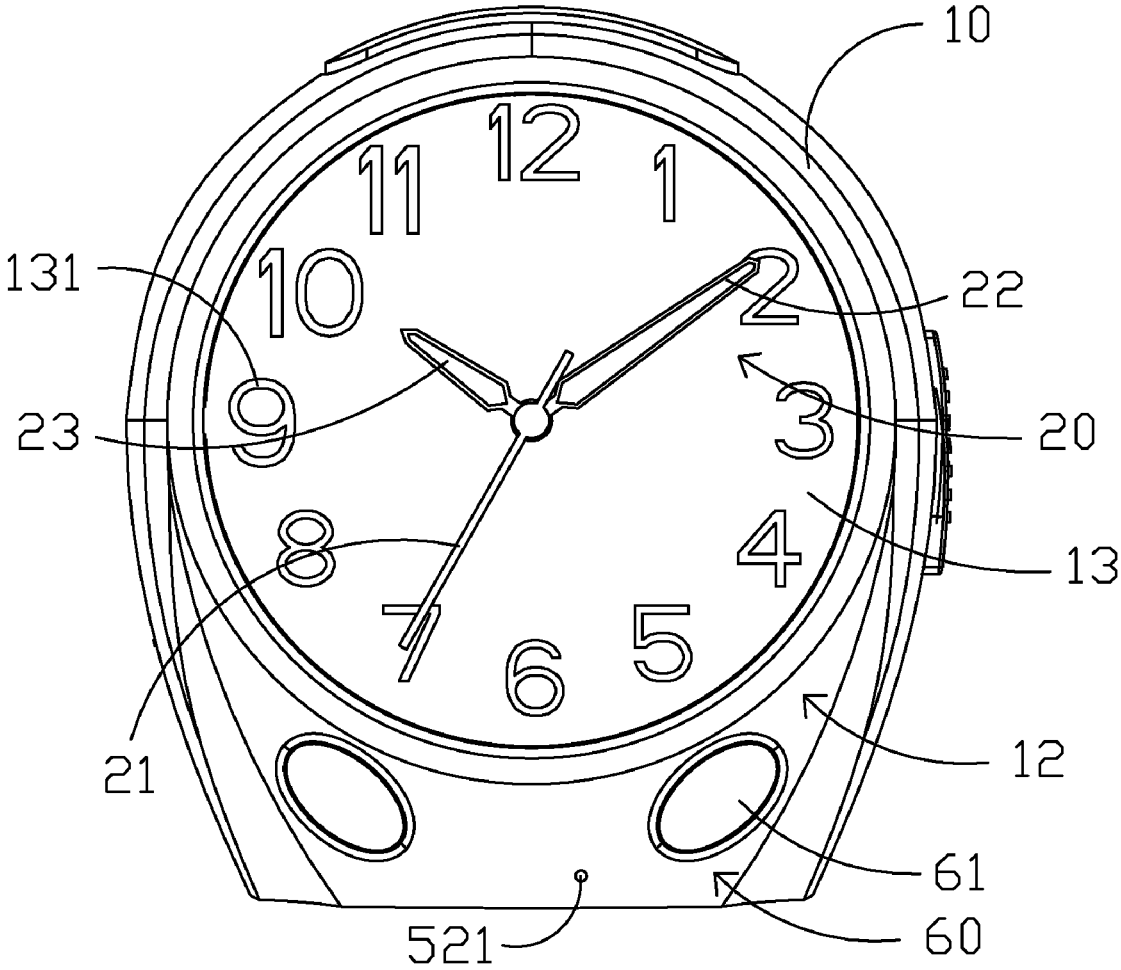
FIG. 1A and FIG. 1B are schematic diagrams of a radio controlled clock according to a preferred embodiment of the present invention.
Figure 1B:
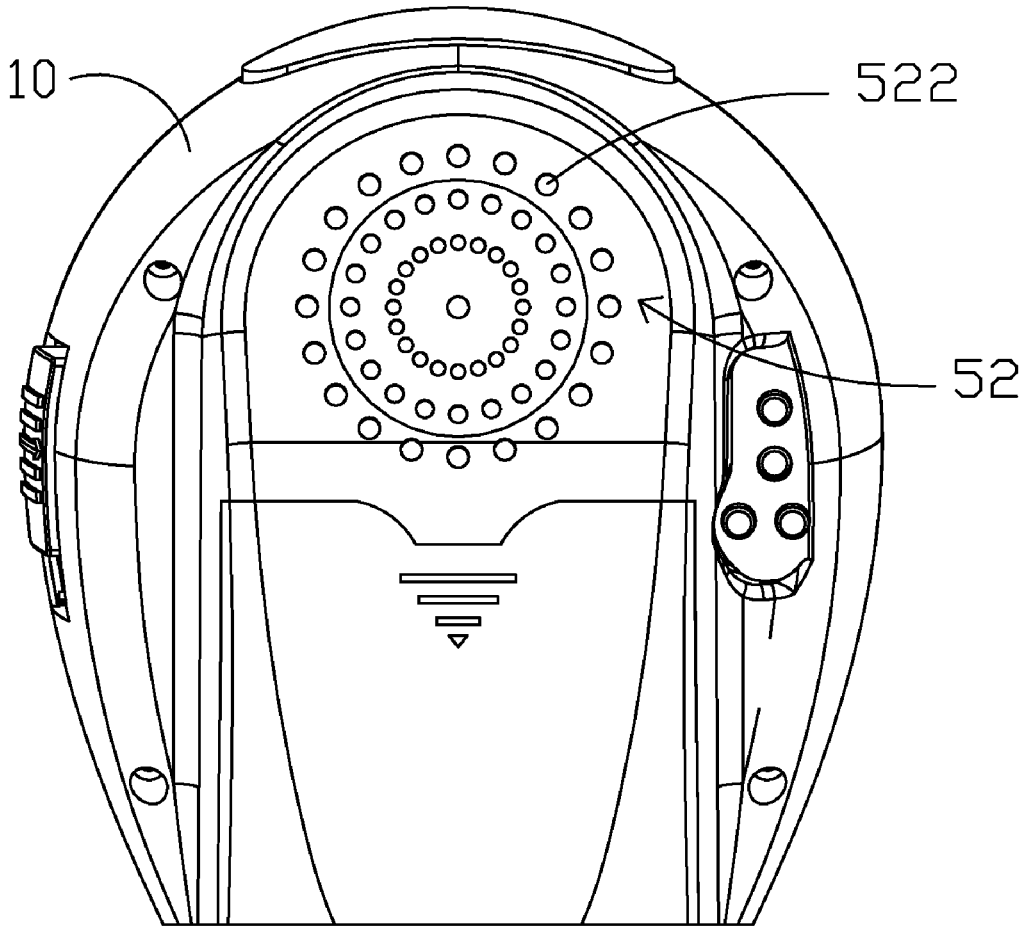
Figure 2:
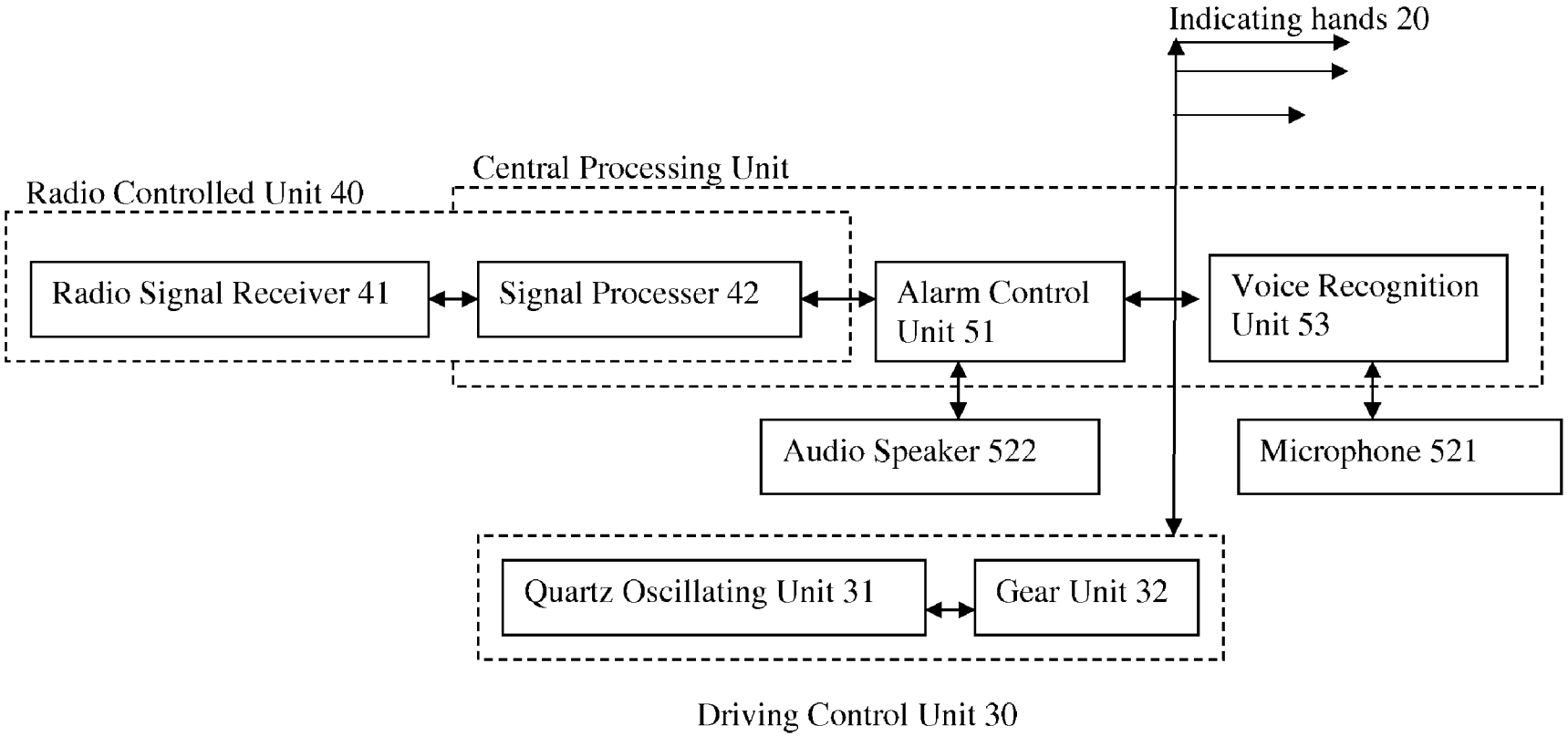
FIG. 2 is a schematic diagram of the radio controlled clock according to the preferred embodiment of the present invention.
Figure 3:
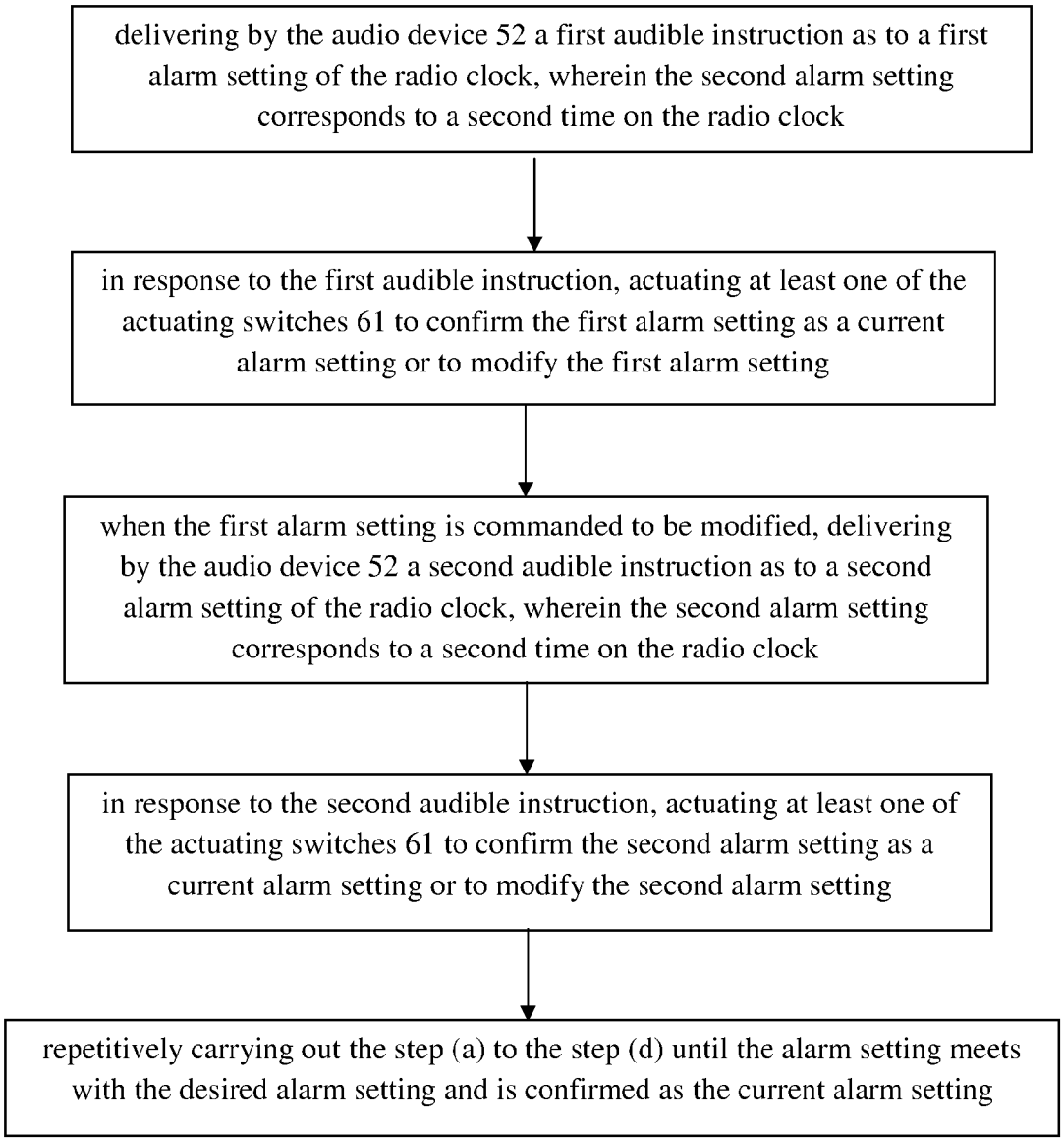
FIG. 3 is a flow chart showing a method of setting an alarm of a radio controlled clock according to the preferred embodiment of the present invention.

Referring to FIG. 1 to FIG. 3 of the drawings, an analog radio controlled clock according to a preferred embodiment of the present invention is illustrated, in which the radio controlled clock comprises a housing 10, a plurality of indicating hands 20 rotatably supported within the housing 10, a driving control unit 30, a radio controlled unit 40, and an audio alarm arrangement.

The driving control unit 30 is disposed within the housing 10 and communicated with the indicating hands 20 for driving the indicating hands 20 to move at a predetermined interval for indicating time in a continuous basis.

The radio controlled unit 40 is provided in the housing 10 and electrically communicated with the driving control unit 30, wherein the radio controlled unit 40 is adapted to periodically receive radio signal from a reference time station to obtain information of current time, wherein the information of the current time is transmitted to the driving control unit 30 to drive the indicating hands 20 to corresponding positions indicating corresponding current time.

The audio alarm arrangement comprises an alarm control unit 51 and an audio device 52. The alarm control unit 51 is disposed in the housing 10 to communicate with the driving control unit 30 for allowing setup of an alarm time.

The audio device 52 is electrically connected with the alarm control unit 51, and is arranged to generate interactive audible signal to a user regarding setting of the alarm time, wherein the audio device 52 is arranged to receive predetermined commands (such as a physical actuation of the a voice instructions, as described below) and transmits the command received from the user to the alarm control unit 51 which is arranged to accomplish setup of the alarm time, so that the user is able to set up the alarm time through the commands (such as the voice instructions or a physical actuation) input to the controlled radio clock.

According to the preferred embodiment of the present invention, the housing 10 has a receiving cavity for receiving the indicating hands 20, the driving control unit 30, the radio controlled unit 40, and the audio alarm arrangement, a display window 12 formed on a front side of the housing 10, and comprises a time chart 13 having a plurality of time markers 131 spacedly provided thereon for indicating time information, that is, at least one of hour information, minute information and second information.

The indicating hands 20 are embodied as consisting at one of a second hand 21 for indicating second information, a minute hand 22 for indicating minute information, and an hour hand 23 for indicating hour information. The indicating hands 20 are driven by the driving control unit 30 for continuously rotating on the time chart 13 for indicating time information (i.e. the second information, minute information and the hour information).

The driving control unit 30 comprises a quartz oscillating unit 31 adapted for generating oscillations for a predetermined period of time (usually one second), and a gear unit 32 mechanically communicating between the quartz oscillating unit 31 and the indicating hands 20 for driving the indicating hands 20 to move on the time chart 13 for every predetermined period of time. The gear unit 32 is preferably embodied as a fully automatic hands alignment gearbox (such as a ferrite antenna radio controlled control gearbox) or any other gearbox available in the market, which is capable of driving the indicating hands 20 to move in the housing 10. As a simple description, the fully automatic gearbox has a plurality of light sensors and is able to detect the location of predetermined indicating hands 20 at 12 o'clock position. One light sensor is responsible to detect second hand 21 and the other is used to detect hour 22 and minute hands 23.

On the other hand, the gear unit 32 may be embodied as a semi-automatic gear box which utilizes generic gearbox as its main component which is very economical in price. The only operation different between the fully automatic and the semi-automatic are only after battery replacement. All indicating hands 20 will be reset to 12 o'clock position automatically after battery replacement for a fully automatic gearbox. For semi-automatic, after battery replacement, all indicating hands 20 have to align at 12 o'clock by turning a knob (such as one of the actuating switches 61) provided on the housing 10 to set all indicating hands 20 to 12 o'clock position. After all indicating hands 20 are manually set at 12 o'clock, the user needs to push a button to tell the main processor signal processor that indicating hands 20 are set at 12 o'clock. The main processor records the indicating hands 20 position and start to drive them the same ways as the fully automatic gearbox. One way to minimize the user to set the indicating hands 20 to 12 o'clock after battery replacement is that one may install a low battery detector in the circuit so that when battery is low, the main processor drives all indicating hands 20 to stop at 12 o'clock before the battery empty and let all indicating hands 20 stop there and wait for battery replacement. After battery replacement, a user may press a button to confirm that the indicating hands 20 are all stop at 12 o'clock and then the clock starts to synchronize the indicating hands 20 with the received time information through the radio controlled unit 40.

The radio controlled unit 40 comprises a radio signal receiver 41 and a signal processor 42 communicated with the driving control unit 30 and the radio signal receiver 41, wherein the signal processor 42 is adapted for driving the indicating hands 20 to move to a predetermined positions upon receipt of radio signal containing information of current time (and date). When information of the current time is received by the radio signal receiver 41, the signal processor 42 is arranged to drive the indicating hands 20 to move to the corresponding positions through the driving control unit 30. The reason of getting radio signal from the reference time station is to have the internal time to be synchronized with the reference time as delivered by the reference time station. By doing so, the time shown by the analog radio controlled clock is always as accurate as the reference time kept by the reference time station. There is no time tolerance accumulation after time synchronization. But once after time synchronization, the analog radio controlled clock is running by its internal quartz oscillating unit 31 after receipt of the signal to save battery power of the analog radio controlled clock. It is worth mentioning that calendar data (i.e. date information and probable whether information) can also be transmitted from the reference time station so the analog radio controlled clock also has the relevant calendar data.

The analog radio controlled clock further comprises a control panel 60 which comprises a plurality of actuating switches 61 provided on the housing 10 for allowing a user to control the operation of the radio controlled clock. In other words, the control panel 60 is either mechanically or electrically communicated with the driving control unit 30, the radio controlled unit 40 and the audio alarm arrangement to allow the user to operate them through actuation of the corresponding actuating switches 61. It is worth mentioning that the actuating switches 61 may be embodied as actuating buttons or actuating rollers provided on the housing 10 for controlling the operation of the driving control unit 30, the radio controlled unit 40 and the audio control alarm arrangement 50.

The alarm control unit 51 of the audio alarm arrangement is preferably embodied as an alarm control processor which may be incorporated into the signal processor 42. Alternatively, the alarm control unit 51 can be a separate alarm control processor which is arranged to control the operation of the audio alarm arrangement.

The audio device 52 comprises a microphone 521 and an audio speaker 522 which are provided on the housing 10, and are electrically connected with the alarm control unit 51 for accomplishing audio interaction to and from the user of the present invention. More specifically, the microphone 521 is arranged to receive audible instructions from a user regarding the setting of alarm, wherein the audible signal is then processed in the alarm control unit 51 for responding to the user's instructions. On the other hand, the audio speaker 522 is arranged to deliver audible signal to the user for communicating to the user the current alarm setting or the current time information. Moreover, the audio speaker 522 is also arranged to produce an alarm sound when the current time as represented by the movement of the indicating hands 20 meets the alarm setting. Finally, the analog radio controlled clock of the present invention may be powered by a conventional batteries or rechargeable batteries which can be conveniently replaced by the user.

It is important to mention that the signal processor 42 and the alarm control unit 51 can be provided in the analog radio controlled clock as separate processors. Alternatively, they can be electronically combined to form a signal central processing unit for the analog radio controlled clock, wherein the central processing unit processes received signals from the reference time station and commands inputted from the user, so as to coordinate the operation of the analog radio controlled clock.

The operation of the present invention can be summarized as follows: in order for the radio controlled clock to illustrate time, the user may directly observe the indicating hands 20 or, alternatively, may actuate one the predetermined actuating switches 61 to arrange audible announcement of the current time and date information though the audio speaker 522. For example, the announcement may be a sentence which reads "the current time is three fifteen pm". Moreover, the audio speaker 522 is also arranged to announce the date information upon actuation of a predetermined actuating switches 61. For example, the announcement may be a sentence which reads "the current date is Oct. 25, 2008". In other words, the alarm control unit 51 is pre-programmed to activate the audio speaker 522 to deliver time and date information in a real time basis upon a specific actuation by the user, such as actuating at least one of the actuating switches 61 on the control panel 60. In other words, the audio device 52 is arranged to deliver audible instructions (such as the announcement read by the audio speaker 522) and information to the user for modification of the alarm setting, and that a user is able to respond to the audible instructions by actuating the actuating switches 61 so as to establish the audio interaction between the audio alarm arrangement and the user for modification of the alarm setting.

In order set time, the user has to actuate a predetermined actuating switch 61 in a predetermined manner on the housing 10, wherein the audio speaker 522 is activated to confirm the current time setting. For example, the reception of the radio signal by the radio signal receiver 41 is successful and the corresponding time has been updated, the audio speaker 522 is arranged to deliver an audible signal which speaks a country name, follow by "Time Updated" announcement. It is worth mentioning that the user may need to actuate one of the predetermined actuating switches 61 to set the correct time zone and/or the day light saving time setting in the location in which the radio clock operates (such as a Pacific Time Zone).

In order to allow diverse sound announcements given by the audio speaker 522, the alarm control unit 51 further comprises a database 53 for pre-storing data of different audio signals or commands which can be reproduced by the audio speaker 522. The audio signals can be pre-installed to the database 53, or it can be recorded so that the audible sound produced by the audio speaker 522 is similar to the pronunciation of a real person.

In order to set alarm, the user has to actuate at least one of the predetermined actuating switches 61 on the control panel 60 while the indicating hands 20 are moving regularly to illustrate time information for switching the radio clock to an alarm setting mode. According to the preferred embodiment of the present invention, the actuating switches 61 for switching the radio clock to an alarm setting mode are actuating buttons so that the visually impaired is able to conveniently set up the alarm of the radio controlled clock of the present invention through the audio alarm arrangement.

When the radio controlled clock is in the alarm setting mode, the user needs to actuate one of the actuating switches 61 (actuating button) in a predetermined manner, wherein the audio speaker 522 will then be activated to announce the current alarm setting. Note that the predetermined actuating switch 61 may be determined through voice prompting from the audio speaker 522. For example, the audio speaker 522 may be activated to read "for hour setting, press S1 (a name of a predetermined actuating button appeared on the housing 10)". At the same time, the second hand 21 will stops at a predetermined position (such as the 12:00 position) to indicate that the radio controlled clock is in the alarm setting mode. The user then needs to continuously actuate a predetermined switch 61 to allow adjustment of the alarm setting. Once the user actuates the corresponding actuating switch 61, the alarm control unit 51 will activate the audio speaker 522 to announce a proposed new setting of the alarm. For example, when the user actuates the predetermined actuating switch 61, the audio speaker 522 will announce the next discrete setting of the alarm (such as 3 o'clock pm). A sequent actuation of that actuating switch 61 will activate the audio speaker 522 to speak the next alarm setting (such as 4 o'clock pm). And when the user wishes to set an alarm time which is six o'clock pm, the user needs to actuate the predetermined actuating switch 61 two more times until the audio speaker 522 speaks "six o'clock pm". When the audio speaker 522 speaks the correct or desired alarm hour setting, the user needs to actuate another actuating switch 61 to confirm such an alarm setting.

The minute setting for the alarm is similar to the above procedure, except that the audio speaker 522 is now arranged to announce the minute information of the desired alarm setting, such as "30 minute".

Once the alarm setting for hour has been completed, the user needs to actuate one of the predetermined actuating switches 61 (actuating button) in a predetermined manner for alarm minute setup, wherein the audio speaker 522 will then be activated to announce the current alarm setting for minute information. Note that the predetermined actuating switch 61 may be determined through voice prompting from the audio speaker 522. For example, the audio speaker 522 may be activated to read "for minute setting, press S2 (a name of a predetermined actuating button appeared on the housing 10)". The user then needs to continuously actuate a predetermined switch 61 to activate adjustment of the alarm minute setting. Once the user actuates the corresponding actuating switch 61, the alarm control unit 51 will activate the audio speaker 522 to announce a proposed new setting of the alarm for the minute setting. For example, when the user actuates the predetermined actuating switch 61, the audio speaker 522 will verbally announce the next discrete setting of the alarm (a first alarm setting such as 30 minute). A sequent actuation of that actuating switch 61 will activate the audio speaker 522 to speak the next alarm setting a second alarm setting such as 31 minute). And when the user wishes to set an alarm time which is 6:45 pm, the user needs to actuate the predetermined actuating switch 61 fourteen more times until the audio speaker 522 speaks "45 minute". When the audio speaker 522 speaks the correct or desired alarm hour setting, the user needs to actuate another actuating switch 61 to confirm such an alarm setting. Once the desired alarm time has been set, the user needs to actuate a predetermined actuating switch 61 to end the alarm setting mode so that the indicating hands 20 will resume to their normal operation. The audio speaker 522 is then arranged to produce an alarm signal whenever the indicating hands 20 reaches the newly set alarm time. After the alarm time is confirmed, the alarm control unit 51 saves the alarm time inside in a digital way in the sense that the alarm setting is accomplished through audible voice signal and the corresponding reaction inputted by the user of the present invention. When the positions of the indicating hands 20 matches with the alarm time kept inside the alarm control unit 51, the alarm control unit 51 is arranged to control the audio device 52 to generate the alarm signal.

The user may stop the alarm signal by actuating a predetermined actuating switch 61. According to the preferred embodiment of the present invention, the alarm signal takes the form of having a "Beep" sound, and that every time the alarm signal is pressed to silence, the audio speaker 522 is arranged to speak the current time information.

To summarize, the present invention according to the preferred embodiment also provides a method of setting up an alarm in a radio clock which comprises a plurality of actuating switches 61, and an audio alarm arrangement comprising an audio device 52, wherein the method comprises the steps of:

(a) delivering by the audio device 52 a first audible instruction as to a first alarm setting of the radio clock, wherein the second alarm setting corresponds to a second time on the radio clock;

(b) in response to the first audible instruction, actuating at least one of the actuating switches 61 to confirm the first alarm setting as a current alarm setting or to modify the first alarm setting; wherein when the first alarm setting meets a desirable alarm setting, the first alarm setting is confirmed as the current alarm setting, wherein when the first alarm setting does not meet a desirable alarm setting, the first alarm setting is commanded to be modified;

(c) when the first alarm setting is commanded to be modified, delivering by the audio device 52 a second audible instruction as to a second alarm setting of the radio clock, wherein the second alarm setting corresponds to a second time on the radio clock;

(d) in response to the second audible instruction, actuating at least one of the actuating switches 61 to confirm the second alarm setting as a current alarm setting or to modify the second alarm setting; and (e) repetitively carrying out the step (a) to the step (d) until the alarm setting meets with the desired alarm setting and is confirmed as the current alarm setting.

The method further comprises a step, before step (a), of actuating at least one of the actuating switches 61 to switch the radio controlled clock to an alarm setting mode. Similarly, the method further comprises a step, after step (e), of ending the alarm setting mode by actuating one of the predetermined actuating switches 61 on the control panel 60 so as to bring the radio clock to show the current time.

It is worth mentioning from the above description, the actuation of the actuating switches 61 can also be accomplished verbally (without physical actuation to the actuating switches 61) by a user through saying a predetermined answer to the microphone 521 of then audio device 52. For example, a user may signal reading of a next setting of an hour alarm setting through reading a predetermined verbal command (such as "next"). For confirmation of a particular alarm time setting, the user may be required to read "confirm" to the microphone 521 for commanding an end of the alarm setting. As such, the audio alarm arrangement further comprises a voice recognition unit 53 electrically connected with alarm control unit 51, and the signal processor 42 (and form part of the central processing unit for the analog radio clock), and is pre-programmed to recognize predetermined verbal commands and hour and minute numbers pronounced by the user of the present invention for alarm and time setting purpose. Hence, the user, instead of actuating the actuating switches 61 for alarm setting, may deliver a verbal instruction to the analog radio controlled clock through the microphone 521, wherein the audio signal will then transmitted to the voice recognition unit 53 to be converted to the corresponding signal setting the alarm time information. The user may also selectively use perform physical actuation of the actuating switches 61 and the voice commands for setting up the alarm time. In other words, the user may, depending on the circumstances of his or her use of the present invention, freely choose to actuate the actuating switches 61 or deliver verbal commands to the microphone 521 as means for modifying or confirm the alarm setting.

Figure 4:
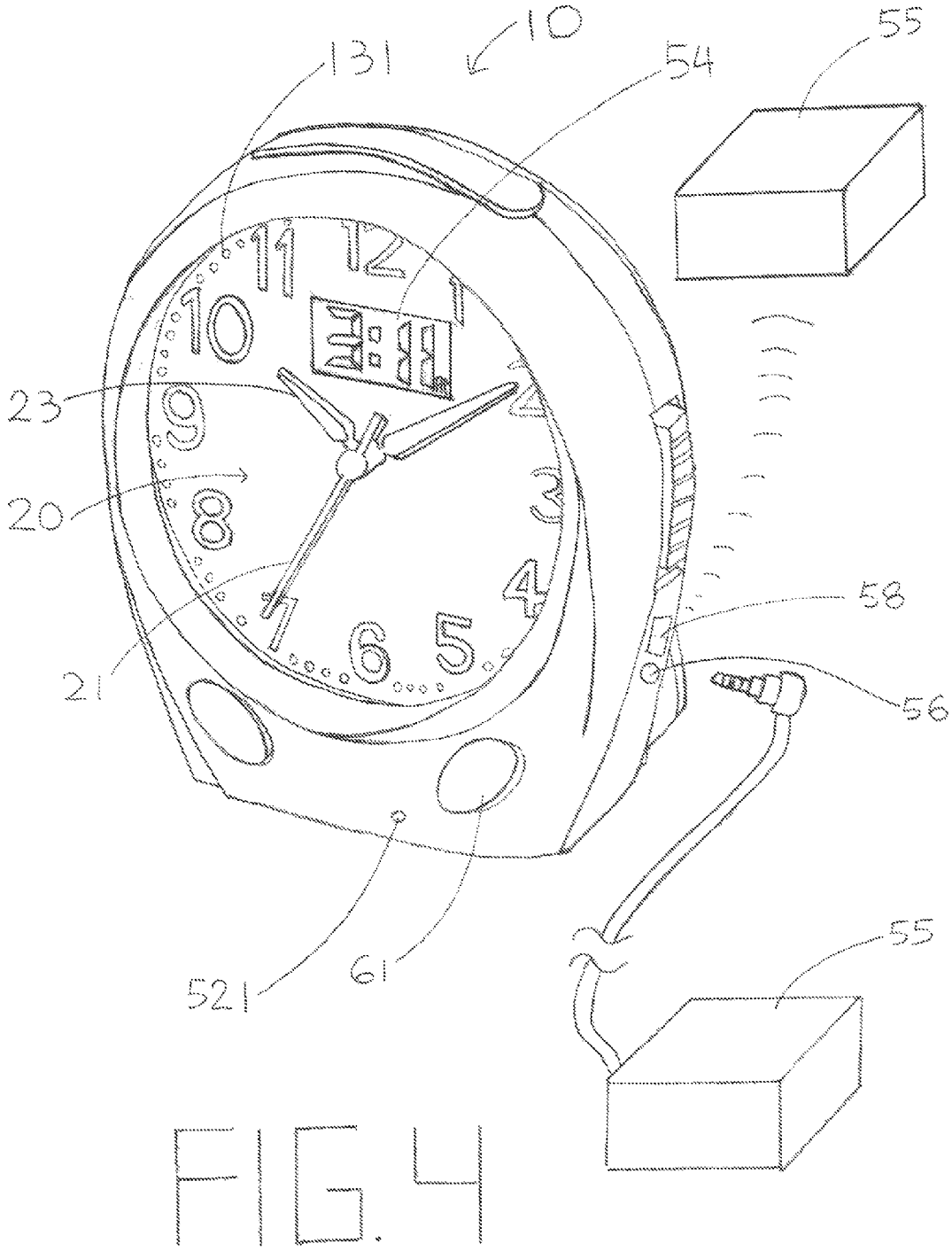
FIG. 4 is an alternative mode of the radio controlled clock according to the preferred embodiment of the present invention.

Referring to FIG. 4 of the drawings, an alternative mode of the analog radio controlled clock according to the preferred embodiment of the present invention is illustrated, wherein the analog radio controlled clock is also adapted for use by hearing impaired people in addition to visually impaired people. The alternative mode is similar to the preferred embodiment except that the alarm is able to be set by "eye" interaction instead of voice as this is specifically catered for deaf people.

According to the alternative mode, the audio alarm arrangement further comprises an alarm display 54 electrically connected with the alarm control unit 51, and an under-pillow vibrator 55 adapted for being extended and placed in the vicinity of a user's pillow, wherein the under-pillow vibrator 55 is arranged to generate a predetermined amount of vibration upon receipt of an activation signal generated by the alarm control unit 51. The under-pillow vibrator 55 is used to wake up their deaf users.

When the analog radio controlled clock talks the alarm setting through the above procedures, the content of the audible signal also displays on the alarm display 54 which is embodied as a digital LCD or LED display provided on the housing 10. For example, when the audio speaker 522 announces that the current alarm time is three thirty PM, the alarm display 54 is arranged to show the corresponding text (i.e. 3:30 pm). When the user further presses the alarm hour setting button (one of the actuating switches 61), the clock would say, 4 o'clock PM, and the alarm display 54 shows 4:30 PM with four flashings (the number of flashings corresponds to the hour of the alarm). When the user further presses the hour setting button (the actuating switches 61), the clock would announce 5 o'clock PM and the alarm display 54 shows 5:30 PM with five flashings. When the user presses the actuating switches 61 for setting minute, the clock announces 31 minute and the alarm display 54 shows 5:31 PM with the 31 flashings (the number of flashings correspond to the minute of the alarm setting). With these procedures, both visually and hearing impaired people can be able to set the alarm of the clock of the present invention in a highly convenient manner.

The audio alarm arrangement 40 further comprises a connection socket 56 provided on the housing 10 for detachably connecting to the under-pillow-vibrator 55 via a connection cable 57. After the under-pillow-vibrator 55 is connected to the housing 10, the alarm control unit 51 is adapted to drive the under-pillow vibrator 55 to vibrate when the alarm time is up. At the same time, the audio speaker 522 is arranged to send out the alarm signal in the same manner described above. With this arrangement, both visually and hearing impaired people can hear and feel the alarm of the clock, and a particular user may select which of the alarm modes (i.e. audio alarm signal or a vibration alarm signal) is going to be used. Alternatively, the under-pillow-vibrator 55 can be wirelessly connected to the central processing unit via a wireless sensor 58 provided on the housing 10.

One skilled in the art will appreciate that the embodiment of the present invention as shown in the drawings and described above is illustrative only and not intended to be limiting. All embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An analog radio controlled clock, comprising:

a housing;

a plurality of indicating hands rotatably supported within said housing;

a driving control unit disposed within said housing and communicated with said indicating hands for driving said indicating hands to move at a predetermined interval for indicating time in a continuous basis;

a radio controlled unit provided in said housing and electrically communicated with said driving control unit, wherein said radio controlled unit is adapted to receive radio signal from a reference time station to obtain information of current time, wherein said information of said current time is transmitted to said driving control unit to drive said indicating hands to corresponding positions indicating corresponding current time; and an audio alarm arrangement, which comprises:

an alarm control unit disposed in said housing to communicate with said driving control unit for allowing setup of an alarm time; and an audio device which is electrically connected with said alarm control unit, and is arranged to generate interactive audible signal to a user regarding setting of said alarm time, wherein said audio device is arranged to receive predetermined commands and transmit said commands received from said user to said alarm control unit to accomplish setup of said alarm time, so that said user is able to set up said alarm time through said command input to said audio device in response to said audible signal, wherein said alarm setting is modified by operating a plurality of actuating switches in response to at least one of first and second audible instructions in the following manner: first, said audio device is first arranged to produce said first audible instruction as to a first alarm setting of said analog radio controlled clock, wherein said first alarm setting corresponds to a first time on said analog radio controlled clock; second, when said first audible instruction is produced, said user is able to actuate at least one of said actuating switches to confirm said first alarm setting as a current alarm setting, or to modify said first alarm setting; wherein when said first alarm setting meets a desired alarm setting, said first alarm setting is confirmed as said current alarm setting, wherein when said first alarm setting does not meet a desirable alarm setting, said first alarm setting is commanded to be modified; third, when said first alarm setting is commanded to be modified, said audio device is arranged to deliver said second audible instruction as to a second alarm setting of said analog radio controlled clock, wherein said second alarm setting corresponds to a second time on said analog radio controlled clock; and fourth, in response to said second audible instruction, said user is able to actuate at least one of said actuating switches to confirm said second alarm setting as a current alarm setting or to modify said second alarm setting, wherein said user is able to repetitively command modifying of said alarm settings until said alarm setting meets said desired alarm setting and is confirmed as said current alarm setting.

2. The analog radio controlled clock, as recited in claim 1, wherein said audio device comprises an audio speaker provided on said housing, and are electrically connected with said alarm control unit for facilitating audio interaction to said user, wherein said audio speaker is arranged to deliver audible signal to said user for communicating to said user a current alarm setting and a current time information, and for establishing modification of said alarm setting.

3. The analog radio controlled clock, as recited in claim 2, wherein said audio device is arranged to deliver audible instructions and information to said user for modification of said alarm setting, such that a user is able to respond to said audible instructions by actuating said actuating switches so as to establish said audio interaction between said audio alarm arrangement and said user for modification of said alarm setting.

4. The analog radio controlled clock, as recited in claim 3, wherein said radio controlled unit comprises a radio signal receiver and a radio signal processor communicated with said driving control unit and said radio signal receiver, wherein said radio signal processor is adapted for driving said indicating hands to move to a predetermined positions upon receipt of radio signal containing information of current time, wherein when said information of said current time is received by said signal receiver, said signal processor is arranged to drive said indicating hands to move to corresponding positions through said driving control unit for indicating said current time.

5. The analog radio controlled clock, as recited in claim 4, wherein said alarm control unit further comprises a database adapted for pre-storing data of different audio signals and commands which are reproduced by said audio speaker for delivering said audible instructions for setting up and modification of said alarm setting.

6. The analog radio controlled clock, as recited in claim 3, wherein said actuating switches are actuating buttons so that a visually impaired user is able to conveniently and easily responding to said audible instructions by pressing said actuating buttons for setting up and modification of said alarm setting of said analog radio controlled clock.

7. The analog radio controlled clock, as recited in claim 5, wherein said actuating switches are actuating buttons so that a visually impaired user is able to conveniently and easily responding to said audible instructions by pressing said actuating buttons for setting up and modification of said alarm setting of said analog radio controlled clock.

8. The analog radio controlled clock, as recited in claim 3, wherein said audio alarm arrangement further comprises a voice recognition unit which is electrically connected to said alarm control unit and is pre-programmed to recognize a predetermined number of verbal commands and hour and minute numbers, wherein said audio device further comprises a microphone provided on said housing to electrically connect with said voice recognition unit, in such a manner that said microphone is adapted to receive verbal commands delivered from said user as instructions for setting up said alarm time, wherein said verbal commands are recognized and converted in said voice recognition unit which then transmits said converted verbal commands and hour and minute numbers to said alarm control unit as instructions for modifying and setting up said alarm time.

9. The analog radio controlled clock, as recited in claim 5, wherein said audio alarm arrangement further comprises a voice recognition unit which is electrically connected to said alarm control unit and is pre-programmed to recognize a predetermined number of verbal commands and hour and minute numbers, wherein said audio device further comprises a microphone provided on said housing to electrically connect with said voice recognition unit, in such a manner that said microphone is adapted to selectively receive verbal commands delivered from said user as instructions for setting up said alarm time, wherein said verbal commands and hour and minute numbers are recognized and converted in said voice recognition unit which then transmits said converted verbal commands and hour and minute numbers to said alarm control unit as instructions for modifying and setting up said alarm time.

10. The analog radio controlled clock, as recited in claim 7, wherein said audio alarm arrangement further comprises a voice recognition unit which is electrically connected to said alarm control unit and is pre-programmed to recognize a predetermined number of verbal commands and hour and minute numbers, wherein said audio device further comprises a microphone provided on said housing to electrically connect with said voice recognition unit, in such a manner that said microphone is adapted to selectively receive verbal commands and hour and minute numbers delivered from said user as instructions for setting up said alarm time, wherein said verbal commands and hour and minute numbers are recognized and converted in said voice recognition unit which then transmits said converted verbal commands and hour and minute numbers to said alarm control unit as instructions for modifying and setting up said alarm time.

11. The analog radio controlled clock, as recited in claim 8, wherein said audio alarm arrangement further comprises an alarm display electrically connected with said alarm control unit for displaying said audible signal announced by said audio device, and an under-pillow vibrator electrically extended from said housing to be placed in a vicinity of a user's pillow, wherein said under-pillow vibrator is arranged to generate a predetermined amount of vibration upon receipt of an activation signal generated by said alarm control unit, wherein when said user finishes setting said alarm time, said alarm control unit is adapted to drive said under-pillow vibrator to vibrate when said alarm time is meets with a current time, so that a user having hearing difficulty is able to set up said alarm time through said audio alarm arrangement and alerted by said vibration generated by said under-pillow vibrator.

12. The analog radio controlled clock, as recited in claim 9, wherein said audio alarm arrangement further comprises an alarm display electrically connected with said alarm control unit for displaying said audible signal announced by said audio device, and an under-pillow vibrator electrically extended from said housing to be placed in a vicinity of a user's pillow, wherein said under-pillow vibrator is arranged to generate a predetermined amount of vibration upon receipt of an activation signal generated by said alarm control unit, wherein when said user finishes setting said alarm time, said alarm control unit is adapted to drive said under-pillow vibrator to vibrate when said alarm time is meets with a current time, so that a user having hearing difficulty is able to set up said alarm time through said audio alarm arrangement and alerted by said vibration generated by said under-pillow vibrator.

13. The analog radio controlled clock, as recited in claim 10, wherein said audio alarm arrangement further comprises an alarm display electrically connected with said alarm control unit for displaying said audible signal announced by said audio device, and an under-pillow vibrator electrically extended from said housing to be placed in a vicinity of a user's pillow, wherein said under-pillow vibrator is arranged to generate a predetermined amount of vibration upon receipt of an activation signal generated by said alarm control unit, wherein when said user finishes setting said alarm time, said alarm control unit is adapted to drive said under-pillow vibrator to vibrate when said alarm time is meets with a current time, so that a user having hearing difficulty is able to set up said alarm time through said audio alarm arrangement and alerted by said vibration generated by said under-pillow vibrator.

14. A method of setting up an alarm in an analog radio controlled clock which comprises a plurality of actuating switches, and an audio alarm arrangement comprising an audio device, wherein said method comprises the steps of:

(1) actuating at least one of said actuating switches to switch said analog radio controlled clock to an alarm setting mode;

(2) delivering by said audio device a first audible instruction as to a first alarm setting of said analog radio controlled clock, wherein said first alarm setting corresponds to a first time on said analog radio clock;

(3) in response to said first audible instruction, actuating at least one of said actuating switches to confirm said first alarm setting as a current alarm setting or to modify said first alarm setting; wherein when said first alarm setting meets a desirable alarm setting, said first alarm setting is confirmed as said current alarm setting, wherein when said first alarm setting does not meet a desirable alarm setting, said first alarm setting is commanded to be modified;

(4) when said first alarm setting is commanded to be modified, delivering by said audio device a second audible instruction as to a second alarm setting of said analog radio clock, wherein said second alarm setting corresponds to a second time on said analog radio clock;

(5) in response to said second audible instruction, actuating at least one of said actuating switches to confirm said second alarm setting as a current alarm setting or to modify said second alarm setting; and (6) repetitively carrying out said step (1) to said step (5) until said alarm setting meets with said desired alarm setting and is confirmed as said current alarm setting.

15. The method, as recited in claim 14, further comprising a step, after said step (2), of actuating at least one of said actuating switches to switch said analog radio controlled clock to end said alarm setting mode for allowing said analog radio controlled clock to show current time.

16. The method, as recited in claim 15, wherein said audio device comprises an audio speaker provided on said housing, and are electrically connected with said alarm control unit for facilitating audio interaction to said user, wherein said audio speaker is arranged to deliver audible signal to said user for communicating to said user a current alarm setting and a current time information, and for establishing modification of said alarm setting.

17. The method, as recited in claim 16, wherein said actuating switches are actuating buttons so that a visually impaired user is able to conveniently and easily responding to said audible instructions by pressing said actuating buttons for setting up and modification of said alarm setting of said analog radio controlled clock.

18. The method, as recited in claim 17, wherein said audio alarm arrangement further comprises a voice recognition unit which is electrically connected to said alarm control unit and is pre-programmed to recognize a predetermined number of verbal commands and hour and minute numbers, wherein said audio device further comprises a microphone provided on said housing to electrically connect with said voice recognition unit, in such a manner that said microphone is adapted to selectively receive verbal commands and hour and minute numbers delivered from said user as instructions for setting up said alarm time, wherein said verbal commands and hour and minute numbers are recognized and converted in said voice recognition unit which then transmits said converted verbal commands and hour and minute numbers to said alarm control unit as instructions for modifying and setting up said alarm time.

* * * * *